United States Patent [19]

Robbins et al.

[11] 4,390,111

[45] Jun. 28, 1983

[54] SEALABLE VIAL

[75] Inventors: Arthur J. Robbins, Mountain View; Paul B. Robbins, Palo Alto; Dennis C. Thompson, Campbell, all of Calif.

[73] Assignee: Robbins Scientific Corporation, Mt.View, Calif.

[21] Appl. No.: 346,488

[22] Filed: Feb. 8, 1982

[51] Int. Cl.[3] ..... B65D 43/16; B65D 43/18; B65D 51/18

[52] U.S. Cl. ..... 220/259; 220/256; 220/375; 215/235; 215/354

[58] Field of Search ..... 220/256, 259, 375; 215/341, 235, 354

[56] References Cited

U.S. PATENT DOCUMENTS

| | | | |
|---|---|---|---|
| 3,419,179 | 12/1968 | Deuschle et al. | 220/375 X |
| 3,570,703 | 3/1971 | MacRae | 220/256 |
| 3,587,944 | 6/1971 | Pehr | 220/256 X |
| 3,997,077 | 12/1976 | Mill et al. | 215/354 X |
| 4,019,646 | 4/1977 | Imamura | 215/354 X |

*Primary Examiner*—George T. Hall

*Attorney, Agent, or Firm*—Michael J. Hughes

[57] ABSTRACT

The present invention is an improved sealable vial for storage of materials. The vial includes a tubular body portion sealed at one end and provided with an aperture at the opposite end. The tubular body is further provided with a male spiral thread about the aperture end and a tapered section extending inward from the aperture. A sealing insert is attached to the body for positioning in either a closed position wherein it seals the aperture or an open position wherein the aperture is open. A cap fits over the sealing insert in the closed position and seals the vial. The cap includes female threads which mate with the male threads of the tubular body to secure the closure.

The vial is particularly adapted for cryogenic storage of organic samples. The vial is also adaptable to other applications wherein complete sealing is required under wide temperature and pressure range conditions. The improved seals provided by the interface between the sealing insert and the tubular body prevent leakage into or out of the vial.

15 Claims, 3 Drawing Figures

SEALABLE VIAL

TECHNICAL FIELD

The present invention relates generally to containers and more particularly to sealable containers for cryogenic and similar high integrity sealing applications. The predominant current usage of the containers of the present invention is in the cryogenic storage of living organism or tissue samples. These samples are ordinarily stored in liquid nitrogen.

BACKGROUND ART

Cultures of living organisms and tissue have recently become of extreme commercial and scientific value. Specialized bacteria have been developed for a wide variety of purposes, such as catabolism of organic waste products and preparation of materials for production. Other organic cultures, such as cell tissue cultures, have commercial value relating to testing of pharmaceuticals, vaccine and antibiotic production and in other usages.

Need for effective storage and preservation techniques has arisen concurrently with the increasing utilization of organic organism and tissue cultures. Various devices and methods have been utilized in attempts to maximize retention of tissue viability while minimizing cost, hazards and handling difficulties.

The most commonly used storage techniques relate to cryogenic methods. Organic tissue may be effectively reconstituted after quick freezing if proper procedures are followed. The best results have been obtained using liquid nitrogen ($LN_2$) as the cryogenic medium. Nitrogen condenses from a gas to a liquid at −195.8° C. (77.4° K.,-320.4° F.). Thus cultures stored in $LN_2$ are subjected to extremely cold temperatures relative to ordinary conditions.

Various difficulties follow from the use of $LN_2$ as a cryogenic medium. Initially, many common storage container materials are unsuitable for use at such low temperatures. Therefore it is necessary to select materials for culture containers which can withstand the extreme temperature ranges from room and incubation temperature to the liquid nitrogen storage conditions. In addition to fragility at low temperatures, the materials's thermal expansion characteristics may also cause problems. In most cryogenic and other viable tissue applications it is mandatory that a complete seal be maintained at all times. Leakage may cause contamination or extinction of the sample. Thus a container must be constructed in such a manner and of such materials that contraction and expansion of the materials do not lead to any leaks.

A further consideration in construction of cryogenic vials relates to strength under pressure gradients. Gases and liquids contained in the vials will significantly contract and expand in response to temperature changes. Since the volume of the vial remains relatively constant, the internal pressure will vary considerably. Thus the container walls and seal must be strong enough to withstand the pressure gradients.

Another consideration is the necessity that the vessels be sterilizable so that the cultures are not contaminated. This is especially important if the containers are intended to be used more than once.

The traditional containment vessels for cryogenic preservation of cultures have been glass vials which are filled and then sealed by melting the aperture shut. The glass vials are not entirely satisfactory since they are not reusable. Furthermore, inherent weaknesses in the vessel walls in the vicinity of the seal can often lead to leaks and or explosions. It is not unusual for 10% of a collection of samples to be lost upon thawing due either to explosions or to vessel leakage which destroys the viability of the sample. Nonetheless, the failure of alternate vessels to solve the other problems inherent in cryogenic storage has resulted in the continued usage of disposable glass vials.

Various attempts have been made in the art to develop alternate storage vessels for cryogenic uses. Plastic vials having exterior threads for receiving a cap are manufactured by the Wheaton Company. Vials having interior threads are distributed by A/S Nunc of Denmark and Dynatech. Each of these vials may be sealed. These vials use the threads as the primary seal, although the Nunc devices also include a gasket as a secondary seal. The prior art vials are less than satisfactory in one or more ways in that they are subject to cracking, breakage and leakage and may also be complex and expensive to manufacture.

The present inventors are unaware of any existing patents dealing specifically with cryogenic containers or methods for sealing. However, containers and seals adapted for similar purposes have been the subject of several prior patents.

U.S. Pat. No. 3,032,225, issued to S. Harding disclosed a closure for a sealed vessel including a disposable inner seal and an outer screw cap. U.S. Pat. No. 3,860,135 issued to a Yung, et al, discloses a container with an attached cap. Dual element sealing caps are also disclosed by U.S. Pat. Nos. 3,804,284 issued to Moore, et al and 3,877,598, issued to Hazard. Additional sealing means are disclosed in U.S. Pat. Nos. 4,211,33, issued to Villarejos and 2,987,175, issued to E. W. Bottum.

The Harding disclosure is particularly adapted for use on soft drink bottles and similar containers. It envisions a disposable metal inner cap which is molded about the top of the container. An outer threaded cap is then placed on the bottle over the inner cap. A central depression in the caps causes the inner cap to be forced into the bottleneck and thus, increases the integrity of the seal. The inner cap is destroyed upon opening and cannot be reused. The Harding sealing method would not be applicable to cryogenic storage since the use of different materials for the inner cap and the bottle, required for the Harding technique to work, would result in unavoidable gaps in the seal caused by nonuniform thermal expansion characteristics.

The Moore et al device also utilizes a separate inner cap. The Moore et al device is adapted for large, complex applications and the inner cap is intended to be substantially deformed during use. The device is not appropriate for cryogenic use due to its material requirements and complexity.

None of the prior art methods solve the various problems associated with cryogenic storage of living organic organisms and tissue under a tight seal in economical, simple and reliable manners.

DISCLOSURE OF INVENTION

Accordingly, it is an object of the present invention to provide an improved sealable cryogenic vial which is simple and economical to manufacture.

It is another object of the present invention to provide means for sealing a cryogenic vial for use with viable organic organisms and tissues.

It is a further object of the present invention to provide an improved sealable container that is convenient to use and may be resealed without removing the contents.

It is yet another object of the present invention to provide an economical container with improved sealing characteristics under varying temperature and pressure conditions.

The invention relates to devices incorporating an improved means of sealing a reusable container for use over a wide range of temperatures and pressures. It is particularly adapted to storage vials used in liquid nitrogen environments.

Briefly, a preferred embodiment of the present invention is an improved sealable vial especially intended for use as a sealed container for cryogenic storage of viable organic tissue in liquid nitrogen. The vial includes a tubular body element with the bottom end formed to provide a pressure resistant seal. The upper end of the body includes exterior threads for receiving a cap and further having a tapered aperture for receiving a deformable sealing insert. The sealing insert is flexibly attached to the tube body such that it may rotate into a sealing position wherein it is engaged within the aperture or to an open position wherein the aperture is cleared. A detached exterior cap, including depression means for depressing and deforming the sealing insert when it is in the sealing position and forcing the sealing insert into a tight seal with the tube body, is adapted to screw onto the exterior threads of the tube.

An advantage of the present invention is that the use of the attached sealing insert strengthens the seal and provides an improved barrier to leakage or contamination of the contents.

Another advantage of the invention is that the vial may be readily opened and then resealed.

A further advantage of the invention is that the vial may be economically manufactured out of a uniform material, thus alleviating anisotropic thermal expansion problems.

These and other objects and advantages of the present invention will become clear to those skilled in the art in light of the description of the best presently known method of carrying out the invention and the industrial applicability of the preferred embodiment as illustrated in the drawing.

BEST MODE FOR CARRYING OUT INVENTION

Figure 1:
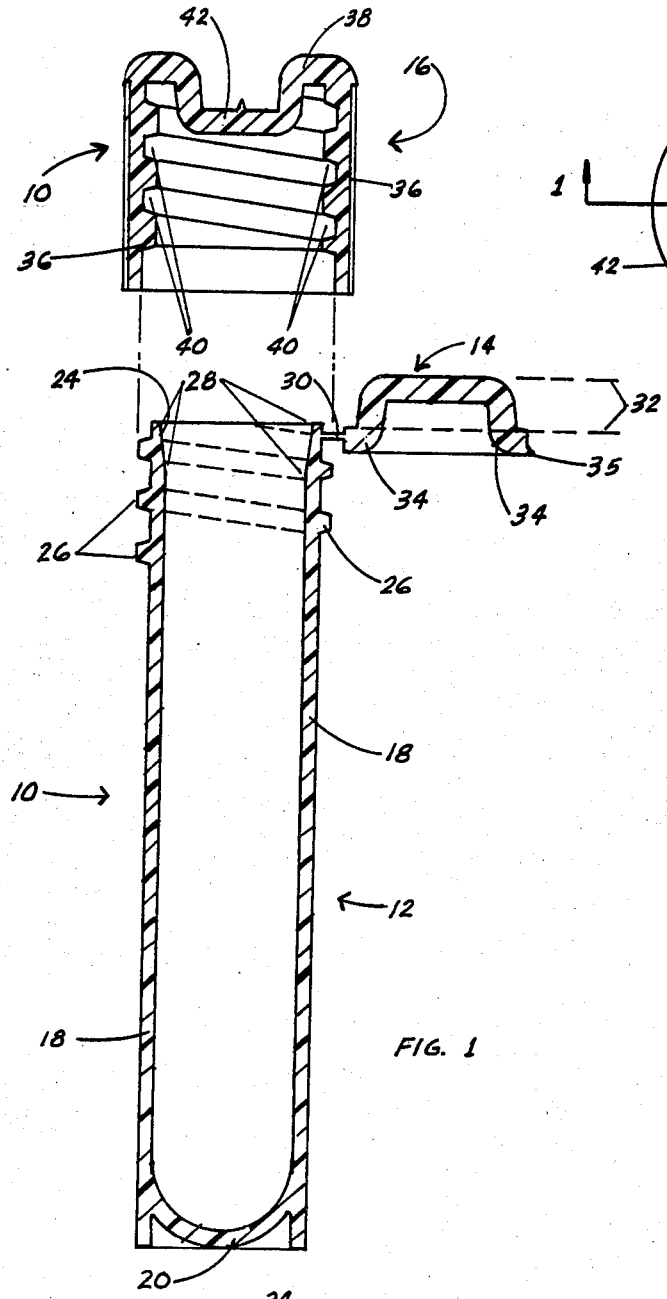
FIG. 1 is a vertical cross section of an improved, sealable cryogenic vial device in accordance with the present invention.
Figure 2:
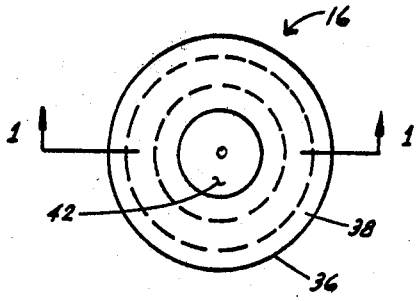
FIG. 2 is a top plan view of the cap element of the vial of FIG. 1.

The best presently known mode of practicing the present invention is a sealable and resealable cryogenic vial as illustrated in the drawing. The vial is especially adapted for containing and protecting viable organic bacteria, viruses and tissues which are to be stored in liquid nitrogen or another cryogenic medium.

The presently preferred cryogenic vial is shown in vertical cross section in FIG. 1 and is designated by the general reference character 10. The vial 10 includes a tubular body 12, an integrally attached deformable sealing insert 14 and a separate cap 16. These elements interact to form a tightly sealed container impervious to the temperature and pressure gradients which occur during cryogenic freezing and reconstitution. The sample or other contents are placed within the tube 12.

The tubular body 12 is in the shape of an elongated cylinder. The tube 12 includes a tube wall 18 having an interior diameter greatly exceeding its thickness so as to form a cylindrical interior cavity. The tube wall 18 is uniform in thickness along most of its length.

At one end of the tube 12 a base wall which seals that end of the tube. Base wall 20 is selected to have the shape of a segment of a sphere with the origin point of the sphere located on the tube axis in the interior of the tube 12 for increased strength under pressurized conditions. The curved base wall 20 also provides for easy recovery of contents and also for easy cleaning. It is desirable that the base wall 20 and the tube wall 18 be integrally formed by a method such as injection molding to provide maximum strength. Base wall 20 is recessed from the end of tube wall 18 sufficiently that the base wall 20 does not interfere with the flat bottom surface of the vial. Such recession permits the vial 10 to be stably set in a vertical orientation without the necessity of independent support structures. The recession also permits stable nesting of the vial in various storage containers and racks.

At the end of the tube opposite base wall 20 the tube wall 18 is open to form an aperture 24. Aperture 24 is circular in shape and provides the means for access to the interior of the vial 10.

The exterior surface of tube wall 18 in the vicinity of aperture 24 is provided with a male spiral thread 26. The male thread 26 extends downward in a spiral manner from the aperture 24 for a distance sufficient to provide for a firm attachment of the cap 16 to the tube 12.

The interior surface of tube wall 18 in the vicinity of the aperture is formed to include a tapered section 28. The tapered section 28 is formed such that the interior diameter of the tube 12 is greatest at the aperture 24 and that the tube wall 18 inclines to increasing thickness with increasing distance from the aperture 24. The tapered section 28 aids in the provision of a tight expansion seal between the sealing insert 14 and the tube 12.

The sealing insert 14 is connected to the tube 12 b a connecting strip 30. Connecting strip 30 is selected to be flexible to the extent that the sealing insert 14 may be rotated from an open position, as shown in FIG. 1, in which the aperture 24 is open, to a closed position in which the sealing insert 14 mates with the tapered section 28 and provides a seal isolating the contents of vial 10 from the surrounding environment. The connecting strip 30 is situated such that the bulge formed by the folding of the strip 30 over the top of the body 12 acts as a portion of a land of male thread 26. This facilitates sealing the vial since the cap 16 may screw completely onto body 12 with no interference from insert 14.

The sealing insert 14 and connecting strip 30 are integrally formed with the tube 12. This prevents the sealing insert 14 from becoming detached and misplaced or lost. This integral formation also insures uniform material and thermal characteristics.

The sealing insert 14 includes a frustum section 32 in the shape of a hollowed out frustum of a cone. The outside portion of the frustum section 32 is inclined so as to tightly mate with the tapered section 28 of the tube 12. The interior portion of the frustum section 32 is adapted to mate with the cap 16. A wing portion 34 of the sealing insert 14 extends about the top perimeter of frustum section 32 and is adapted to rest on top of the tube 12 when the insert 14 is in the closed position. The wing portion 34 receives the connecting strip 30 and further extends upward into the interior of cap 16 when the cap 16 is attached.

Figure 3:
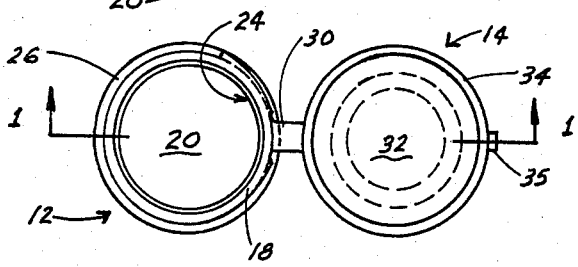
FIG. 3 is a top plan view of the tube and sealing insert elements of the vial.

The wing portion 34 is provided with a protrusion 35 situated opposite the connecting strip 30. Protrusion 35 is particularly shown in FIG. 3. Protrusion 35 provides a leverage point for applying pressure to remove sealing insert 14 from the closed position. This is particularly important if the seal between the insert 14 and the body 12 is lodged such as by chemical action or by a relative internal vacuum. Protrusion 35 is also adapted for fitting into cap 16 so as to allow maximum attachment of cap 16 with downward pressure on insert 14.

The cap 16 is in the shape of a cylindrical solid open at one end. The cap 16 includes a side wall 36 and a top portion 38. The side wall 36 is formed into a cylinder having a minimum inside diameter equal to the outside diameter of the tube 12. The interior of the side wall 36 is provided with a female spiral thread 40 adapted to precisely mate with male spiral thread 26 of the tube 12 so as to form a tight seal between the cap 16 and the tube 12. The exterior of side wall 36 may either be smooth, as shown, or may be provided with gripping ridges or other friction enhancing structure to facilitate tightening and loosening the cap 16.

The top portion 38 is provided with a central depression 42 in the general shape of a hollowed frustum. Central depression 42 is adapted for abutting against the interior of frustum section 32 of insert 14.

As cap 16 is tightened onto male threads 26 the central depression 42 is forced into the interior of frustum section 32 of insert 14 such that the deformable sealing insert 14 is forced to radially expand into an improved tight seal with the tapered section 28 of tube 12. The downward pressure of top portion 38 of cap 16 on the wing portion 34 and protrusion 35 of the insert 14 further forces the insert 14 into the tube 12 and enhances the integrity of the seal therebetween.

The construction of the vial 10, and particularly the inclusion of the sealing insert 14, insures that the seal is formed independent of the precise mating of male spiral threads 26 with female spiral threads 40. The primary seal for the vial 10 is provided at the interface between the frustum section 32 of the insert 14 and the tapered section 28 of the tube 12. The interface between wing portion 34 and the top of the tube wall 18 at aperture 24 provides a secondary seal. A tertiary seal is then provided by the mating of spiral threads 26 and 40. As long as the integrity of any of the seals is maintained, the contents of vial 10 are protected from leakage and contamination. Since the prior art attempts have demonstrated that thread seals are not dependable the emphasis is on the primary and secondary seals.

The material utilized for constructing all elements of the vial 10 must be uniform to avert any gaps caused by disparate thermal expansion and contraction coefficients. The material selected must also be relatively rigid and strong to maintain its integrity and shape under high pressure conditions. However, it must also be sufficiently flexible and deformable to allow the formation of tight seals at planar interfaces. The material must also be selected to withstand the extreme temperature ranges common in cryogenic applications without degradation. The presently preferred material is polypropylene although polyethylene has also been found to be suitable.

The seal forming surfaces, in particular the tapered section 28, the exterior of frustum section 32, the top of tube wall 18, the bottom of wing portion 34 and the male and female spiral threads 26 and 40 must be formed to provide smooth surfaces to facilitate tight seals. Uneven deformation of these surfaces may lead to gaps and improper seals, thus causing failures.

The vial 10 may be constructed to any shape or appropriate dimensions. In one preferred embodiment, the tube 12 is selected to have a volume of 2.0 milliliters, a length of 4.57 cm (1.80 in), an exterior diameter of 0.953 cm (0.375 in) and an interior diameter of 0.813 cm (0.320 in). The base wall 20 has an exterior curvature congruent to that of a sphere having a radius of 0.51 cm (0.20 in). The tapered section 28 is inclined at 7° and has a diameter, at aperture 24, of 0.879 cm (0.346 in). Male threads 26 have a width of 0.107 cm (0.042 in) and a height of 0.153 cm (0.060 in).

Insert 14 is selected to have a wall thickness of 0.127 cm (0.050 in) in the frustum section 32 and a total depth of 0.381 cm (0.150 in). Cap 16 has a total height of 1.27 cm (0.50 in) and an outside diameter of 1.27 cm (0.50 in). The female spiral thread 40 extends to within 0.51 cm (0.20 in) of the bottom of the cap 16 and is inclined at an angle of 15°.

Those skilled in the art will readily observe that numerous modifications and alterations of the device may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

The improved sealable vials of the present invention are particularly adapted for use for cryogenic preservation and storage of viable organic samples under cryogenic conditions. The vials are appropriate for storage of bacterial, viral and cellular cultures in liquid nitrogen.

Since unsealing a vial constructed according to the present invention does not cause any structural damage to the vial, it is possible to reseal and reuse the vial. Reuse will typically be limited to situations wherein a portion of a reconstituted sample is required but it is desirable to refreeze the remainder. This is particularly useful since there is always some transfer loss and threat of contamination any time it is necessary to move a sample from one container to another. The preferred embodiment vials are also adaptable for resterilization and reuse, if proper sterilization techniques, which are nondestructive to the vial material, are utilized. Such reuse is not common in laboratory usage, however, since there are inherent problems with contamination in reused containers. Therefore, the vials are constructed to be economically usable as disposable items.

The vials of the present invention are also appropriate for storage and transport of blood samples and similar organic items. Containers utilizing the sealing types of this invention are of value in any application wherein it is imperative to totally isolate the container's contents from the surroundings.

The sealing and construction techniques of the present invention are adaptable to numerous other uses in which effective seals under wide temperature and pressure gradients are required, and particularly to those circumstances utilizing cryogenic temperatures. Those skilled in the art will readily envisage alternate and additional applications of the invention.

We claim:

1. An improved sealable vial compromising:
a tubular body sealed at one end and having an aperture formed at the opposite end;
a deformable sealing insert attached to the tubular body for mating with the tubular body in the vicinity of said aperture and forming a seal therewith; and
a cap for attachment to the tubular body so as to enclose the sealing insert and secure the vial in a closed mode.

2. The vial of claim 1 wherein:
the tubular body is in the shape of a cylinder and said seal at one end is provided by a base wall in the shape of a segment of a hollow sphere, with the origin of the sphere situated at a point within the tube on the axis of the tube.

3. The vial of claim 1 wherein:
the tubular body includes first thread means on the exterior thereof about the aperture end; and
the cap includes second thread means for mating with said first thread means so as to form a seal therebetween and to secure the cap to the tubular body.

4. The vial of claim 1 wherein:
the tubular body includes a tapered section extending inward from said aperture such that the interior diameter of the tube is greater at said aperture than at the opposite end of the tapered section.

5. The vial of claim 4 wherein:
the sealing insert includes a frustum section adapted for mating with said tapered section of the tubular body so as to form a seal therebetween.

6. The vial of claim 5 wherein:
the sealing insert further includes a wing portion extending about said frustum section for forming a seal with the edge surface of the tube wall of the tubular body about said aperture.

7. The vial of claim 1, 5 or 6 wherein:
the sealing insert is atached to the tublar body by a connecting strip which permits the sealing insert to be moved to and between a closed position, whereby the sealing insert is mated with the tubular body, and an open position, whereby said aperture is unencumbered.

8. The vial of claim 1 wherein:
the cap includes a central depression for forcing the sealing insert into a tight sealing abutment with the tubular body.

9. The vial of claim 6 wherein:
the tubular body includes a first thread means on the exterior surface thereof about the aperture end;
the cap includes second thread means on the interior thereof for mating with said first thread means so as to form a seal therebetween and thereby securing the cap to the tubular body;
the cap further includes a central depression for forcing the sealing insert into a tight sealing abutment with said tapered section and said edge surface of the tube wall of the tubular body; and
the sealing insert is attached to the tubular body by a flexible connecting strip which permits the sealing insert to be moved to and between a closed position, whereby the sealing insert is mated with the tubular body to form a seal about said aperture, and an open position, whereby said aperture is unencumbered.

10. In a cryogenic vial device including a threaded tube sealed at one end and having an aperture at the opposite end and a threaded cap adapted for mating with the tube, the improvement comprising:
a sealing insert attached to the tube, the sealing insert being adapted to mate with the tube in the vicinity of said aperture so as to seal said aperture and the sealing insert being further adapted to be moved to an open position wherein said aperture is unencumbered.

11. The improvement of claim 10 wherein:
the tube includes a tapered section extending inward from said aperture; and
the sealing insert includes a frustum section for mating with said tapered section to form a seal therebetween.

12. The improvement of claim 11 wherein:
the sealing insert further includes a wing portion about said frustum section, said wing portion being adapted for abutting against the edge of the tube wall about said aperture and forming a seal therewith.

13. The improved vial of claim 1 or 10 wherein:
all components of the vial are constructed of materials having identical response to temperature and pressure gradients.

14. The improved vial of claim 13 wherein:
a single material is used for all components of the vial.

15. The improved vial of claim 14 wherein:
said material is polypropylene.

* * * * *